United States Patent [19]

Tani

[11] Patent Number: 4,772,917

[45] Date of Patent: Sep. 20, 1988

[54] COPIER WITH DOUBLE-FACE COPYING AND/OR COMPOSITE COPYING CAPABILITY AND INTERMEDIATE SHEET FEEDER THEREFOR

[75] Inventor: Tatsuo Tani, Urayasu, Japan

[73] Assignee: Ricoh Company, Ltd., Tokyo, Japan

[21] Appl. No.: 835,739

[22] Filed: Mar. 3, 1986

[30] Foreign Application Priority Data

Mar. 5, 1985 [JP] Japan ..... 60-41821
Mar. 8, 1985 [JP] Japan ..... 60-46296

[51] Int. Cl.[4] ..... G03G 21/00
[52] U.S. Cl. ..... 355/14 SH; 271/3.1; 355/24
[58] Field of Search ..... 355/3 R, 3 SH, 14 SH, 355/24, 26; 271/3.1

[56] References Cited

U.S. PATENT DOCUMENTS

| | | | |
|---|---|---|---|
| 4,099,150 | 7/1978 | Connin | 355/3 R |
| 4,190,354 | 2/1980 | Smith et al. | 355/3 SH |
| 4,272,180 | 6/1981 | Satomi et al. | 355/3 SH |
| 4,466,733 | 8/1984 | Pels | 355/24 X |
| 4,537,497 | 8/1985 | Masuda | 355/14 R |

*Primary Examiner*—Fred L. Braun
*Attorney, Agent, or Firm*—Oblon, Fisher, Spivak, McClelland & Maier

[57] ABSTRACT

An intermediate sheet feeder for temporarily stacking copies having one surface provided with document images by a copier having double-face copying and a composite copying capabilities. The sheet feeder includes a first and a second intermediate trays, a selectable guide, and first and second feed devices associated one with each of the trays for re-feeding the copies stacked on the trays. The copies on the first tray are fed beginning with the uppermost one, and those on the second tray beginning with lowermost one.

4 Claims, 8 Drawing Sheets

COPIER WITH DOUBLE-FACE COPYING AND/OR COMPOSITE COPYING CAPABILITY AND INTERMEDIATE SHEET FEEDER THEREFOR

BACKGROUND OF THE INVENTION

The present invention relates to a copier capable of reproducing images on both faces of a sheet and/or reproducing composite images on the same surface of a sheet. More particularly, the present invention is concerned with an intermediate sheet feeder of such a copier which stacks sheets which have been moved past an image forming station and then feed them again to the same station.

A prior art intermediate sheet feeder of the type described which is installed in a copier with a double-face copying and/or a composite copying capability includes a single intermediate tray adapted to stack sheets thereon. The stack of sheets on the intermediate tray are sequentially re-fed by feed means. Sheets are loaded in a stack on the tray with their image-carrying surfaces sometimes faced upward and sometimes downward; usually face up in a both-face copy mode and face down in a composite copy mode. Where the prior art sheet feed means associated with the tray is constructed to sequentially feed the sheets beginning with the top one or with the bottom one, it feeds them beginning with the top one or with the bottom one without exception. The problem with such a construction is that toner on the image-carrying surface of each sheet is apt to adhere to that of the neighboring sheet to noticeably smear the surface of the latter sheet.

Meanwhile, various types of double-face copying systems are known in the art. Where a plurality of volumes of copies each of which is sorted in the same order as a plurality of orderly paged documents is to be produced, it is desirable that copies be provided in sorted bundles, or volumes, in order to save an extra step of sorting copies otherwise performed with a sorter. Especially, in a situation wherein bundles of copies are to be automatically bound one by one by a stapler, the presorted bundles of copies as stated above can be immediately bound as they come out of the copier. Both-face copying in such a mode may typically be implemented with any of two different methods as will be described.

In accordance with a first method, the first page of documents is reproduced on one surface of the first sheet, then the sheet is stacked on the intermediate sheet feeder, then the sheet is re-fed to reproduce the second document page on the other surface of the sheet, then the third and fourth document pages are sequentially reproduced on both faces of the second sheet. This procedure is repeated until all the documents have been reproduced, completing sorted bundles of copies on a volume basis. The drawback with this scheme is that the copying operation consumes a long period of time because after a certain document page has been copied on the first surface of a sheet the next document page cannot be copied until the same sheet returns by way of the intermediate sheet feeder. Especially, where an automatic sheet feeder is used to handle a number of documents within a short period of time, the above procedure increases the time necessary for copying and, thereby, causes half of the value of the automatic sheet feeder to be lost.

In relation to an automatic document feeder, a time-saving copying method is known as will be described.

In accordance with this method, a plurality of documents are sequentially fed by an automatic document feeder to an imaging station inside a copier to reproduce documents every two pages on their first surfaces. The sheets are fed toward the intermediate sheet feeder to be sequentially stacked according to the order of reproduction. Then, the remaining documents are fed one by one by the automatic document feeder to the imaging station so as to be reproduced on the second surfaces of the sheets, which are sequentially fed again out of the intermediate sheet feeder from the top of the stack. The copies so provided with document images on their both faces are discharged to the outside of the copier. This allows a predetermined number of sheets each carrying images on its one surface to be stacked on the intermediate sheet feeder and then sequentially fed again to the imaging station, thereby reducing loss of time.

However, the critical problem with the every-two-pages scheme stated above is that when a sheet fed from the intermediate sheet feeder toward the imaging station has encountered a feed failure and has been discarded either alone or together with the others which lie in a transport path, it is difficult to supplement a substitute for the discarded copy. Specifically, to provide a substitute for the damaged copy, the same images as those which were formed on the first surface of the damaged copy are reproduced on the first surface of a fresh sheet and, then, the sheet is fed into the intermediate sheet feeder. In this case, if sheets which carry images on their first surfaces are present in the intermediate sheet feeder, then the incoming substitute will lie on top of the occupants. In order to sort the resulting bundle of copies, it is necessary for the substitute to be re-fed from the intermediate sheet feeder prior to the others, then provided with the same images as those which were expected to be reproduced on the second surface of the discarded sheet, and then moved out of the copier.

However, the intermediate sheet feeder cannot implement the re-feed of the substitute prior to the others which underlie the substitute, because it is constructed to re-feed a stack of sheets beginning with the bottom sheet. The only expedient heretofore available to cope with such a situation has been discarding the whole stack of copies remaining on the intermediate sheet feeder and then resuming the copying operation, or completing reproduction on all the remaining copies, then producing a substitute for the discarded copy, and then inserting the substitute into the bundle of copies outside of the copier. The former scheme, however, not only leads to the waste of sheets but also invites substantial loss of time due to the extra copying operation. The latter scheme, on the other hand, results in considerably troublesome manipulation especially when the number of copies is great or when a stapler is connected to the copier.

SUMMARY OF THE INVENTION

It is therefore an object of the present invention to provide an intermediate sheet feeder for a copier which, whether copies may be re-fed from the top or the bottom of the stack, frees copies from noticable contamination by toner.

It is another object of the present invention to provide a copier with a double-face copying and/or a composite copying capability which cuts down losses of cost and time.

It is another object of the present invention to provide a generally improved copier with a double-face copying and/or a composite copying capability and an intermediate sheet feeder therefor.

In one aspect of the present invention, there is provided an intermediate sheet feeder for a copier for temporarily stacking copies which have moved past an image forming station and then re-feeding the copies to the image forming station, comprising a first and a second intermediate trays for stacking the copies, a first feed device for feeding the copies which are stacked on the first intermediate tray from an uppermost one of the copies, and a second feed device for feeding the copies which are stacked on the second intermediate tray from a lowermost one of the copies.

In another aspect of the present invention, there is provided a copier having a double-face copying function and a composite copying function, comprising a copier body for copying images which are recorded in documents on fed sheets to produce copies, and an intermediate sheet feeder for temporarily stacking the copies and then re-feeding the copies to the copier body, the intermediate sheet feeder comprising a plurality of trays, a selector for selectively routing the copies into the trays, and a feed device associated one with each of the trays for feeding the copies stacked on the trays, whereby documents fed one by one into the copier body are copied every second page by the copier body, then the copies carrying duplicates of the documents on first surfaces of the copies are sequentially stacked on any of the trays of the intermediate sheet feeder according to the order of reproduction, then images in every alternate second document which are left non-copied and fed into the copier body one by one are copied on second surfaces of the copies which are sequentially fed beginning with the intermediate sheet feeder from a lowermost one of the copies, and then the copies which carry the document images on both surfaces are discharged from the copier body.

The above and other objects, features and advantages of the present invention will become more apparent from the following detailed description taken with the accompanying drawings.

DESCRIPTION OF THE PREFERRED EMBODIMENTS

While the copier with a double-face copying and/or a composite copying capability and an intermediate sheet feeder therefor of the present invention are susceptible of numerous physical embodiments, depending upon the environment and requirements of use, substantial numbers of the herein shown and described embodiments have been made, tested and used, and all have performed in an eminently satisfactory manner.

To better understand the present invention, prior art intermediate sheet feeders which are installed in copiers with the above-mentioned capabilities will be described prior to the present invention.

As already stated, a prior art intermediate sheet feeder which is installed in a copier with a double-face copying and/or a composite copying capability includes a single intermediate tray adapted to stack sheets thereon. The stack of sheets on the intermediate tray are sequentially re-fed by feed means. Sheets are stacked on the tray with their image-carrying surfaces sometimes faced upward and sometimes downward; usually face up in a both-face copy mode and face down in a composite copy mode. Where the prior art sheet feed means associated with the tray is constructed to sequentially feed the sheets beginning with the top one or the bottom one, it feeds them beginning with the top one or with the bottom one without exception.

The drawback particular to the above construction will be described in detail with reference to FIGS. 1 to 3.

Figure 1:
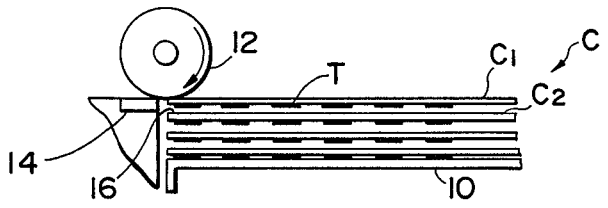
FIG. 1 PRIOR ART
FIG. 1 is a side elevation of a prior art intermediate sheet feeder installed in a copier.
Figure 2:
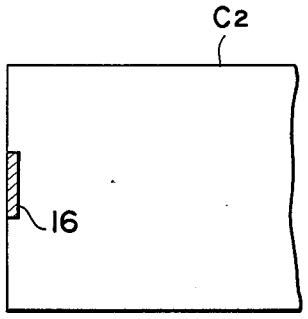
FIG. 2 PRIOR ART
FIG. 2 is a plan view of a copier which is smeared by toner.

Referring to FIG. 1, a prior art intermediate sheet feeder is shown and includes a feed roller 12 and a friction pad 14, which in combination constitute feed means. The roller 12 is pressed against a stack of copy sheets C, precisely the top sheet C1, which are loaded on an intermediate tray 10. Driven clockwise as viewed in FIG. 1, the roller 12 re-feeds the sheets C one by one beginning with the top one C1. Assuming that the sheets S are stacked on the tray 10 with the surfaces carrying reproduced images T faced downward, the image surface of the top sheet C1 which is re-fed first strongly rubs itself against the second sheet C2 while sliding thereon due to the pressure exerted downwardly by the roller 12. As a result, as shown in FIG. 2, toner which comes off the first sheet C1 little by little is collected in that part 16 of the second sheet C2 which underlies the roller 12, thereby smearing the second sheet C2.

Figure 3:
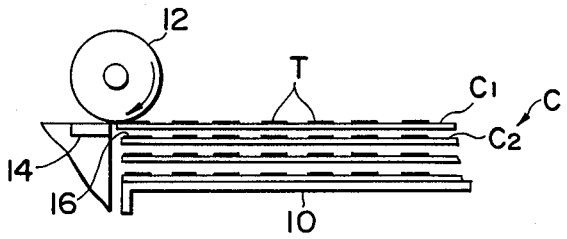
FIG. 3 PRIOR ART
FIG. 3 is a view similar to FIG. 1, showing another prior art intermediate sheet feeder in which copies are positioned in opposite relation to those of FIG. 1.

Meanwhile, as shown in FIG. 3, the copy sheets C may be stacked face up on the tray 10 and fed by the roller 12, the top one C1 first. In this configuration, although the image T carried in that part 16 of the second sheet C2 which underlies the roller 12 makes contact with the first sheet C1, it rubs itself against the first sheet C1 over the entire length of the latter, i.e., from the front end to the rear end. That is, even if a fragment of the toner on the second sheet C2 comes off to become deposited on the first sheet C1, it is scattered over the surface of the sheet C1 so that the contamination by the toner on the sheet C1 is unnoticeable.

The contamination as discussed above with reference to FIGS. 1 and 2 also occurs when copy sheets are stacked face up on the intermediate tray and re-fed from the bottom one. Where copy sheets are stacked face down and re-fed from the top of the stack, no substantial contamination occurs as in the case of FIG. 3.

In this manner, copies are sometimes smeared and sometimes not depending upon the up-down position of their image-carrying surfaces and their re-feed order with respect to the top-bottom direction of the stack. It follows that if the sheets are re-fed constantly in the relationship of FIG. 3, for example, they will be freed from contamination. However, as previously stated, since the up-down position of the image-carrying surfaces of the sheets on the intermediate tray depends upon the copy mode (both-face, composite), it is impractical to constantly employ the configuration of FIG. 3 and, so, it is not rare that the configuration of FIG. 4 is adopted.

Figure 4:
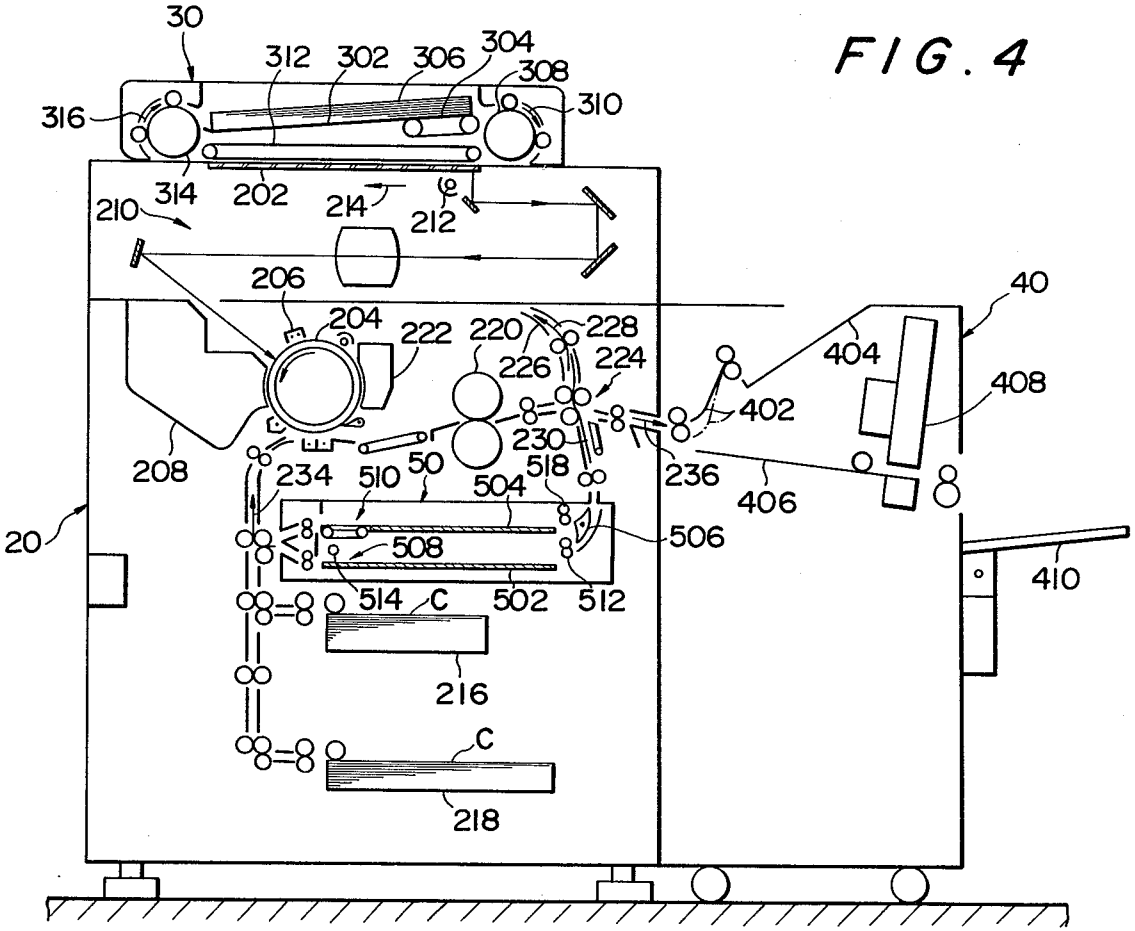
FIG. 4 is a section of a copier equipped with an intermediate sheet feeder embodying the present invention.

Referring to FIG. 4, a copier with an intermediate sheet feeder embodying the present invention is shown. The copier comprises a copier body 20, a recirculating automatic document feeder (RADF) 30 mounted on the copier body 20, and a final processing device 40 connected to the copier body 20 and including a stapler 3.

Arranged on the top of the body 20, the RADF 30 includes a tray 302 and a belt 304 positioned at the right-hand side of the tray 302. One or more documents 306 are loaded on the tray 302 and the belt 304. The document at the bottom of the stack is fed by the belt 304 to the right as viewed in FIG. 4 toward a roller 308 which is rotated clockwise. The document is driven by the roller 308 as indicated by an arrow 310 and then moved onto a glass platen 202 by a belt 312 which is located to face the glass platen 202. The movement of the document is interrupted as soon as the document reaches a predetermined position on the glass platen 202. In this position, the image surface of the document 306 faces the contact glass 202.

The copier body 20 includes a photoconductive drum 204 which is rotatable counterclockwise as viewed in FIG. 4. Arranged around the drum 204 is image forming means which includes a charger 206 and a developing unit 208. An optical imaging device 210 which includes a light source 212 is situated above the drum 204. As the light source 212 which moves as indicated by an arrow 214 scans the document 306 on the contact glass 202, reflection from the document 306 is focused by the imaging device 210 onto surface of the drum 204 which has been charged by the charger 206. As a result, latent images representative of document images are formed electrostatically on the drum 204. While moving past the developing unit 208, the latent images are developed by toner. The resulting toner images are transferred to one of opposite surfaces (first surface) of a sheet C which is fed from a first sheet feeder 216 or a second sheet feeder 218 to an image forming station. The toner images on the sheet C are fixed by a fixing unit 220. Toner particles remaining on the drum 204 are removed by a cleaning unit 222.

The document which has been scanned by the light source 212 is driven again by the belt 312 to the left along the glass platen 202 and then by a turn roller 314 toward the tray 302 as indicated by an arrow 316. In the tray 302, this particular document overlies the others with its image surface faced upward.

In a double-face copy mode in which a sheet provided with images on its first surface is to be provided with images on its other surface (second surface), too, the one-faced copy produced by the above procedure is routed into a reversal guide 226 of a reversing device 224 with the result that the direction of movement of the copy is switched from 228 to 230. Then, the copy is driven into an intermediate sheet feeder 50 in accordance with the present invention.

The intermediate sheet feeder 50 comprises a first intermediate tray 502, a second intermediate tray 504, selector means implemented by a guide member 506 for selectively guiding the one-faced copy to the first and the second trays 502 and 504, and first feed means 508 and second feed means 510 associated respectively with the trays 502 and 504 for feeding the one-faced copies out of their associated trays. In the double-face copy mode, the one-faced copy is routed toward the first tray 502. Specifically, in the double-face copy mode, the guide member 506 is positioned as indicated by a solid line in FIGS. 4 and 5 so that the copy is directed by the guide member 506 and an underlying fixed guide plate toward the first tray 502, while rollers 512 positively drive the copy onto the first tray 502. Since the one-faced copy has already been reversed in direction by the reversing device 224, it has the first or image carrying surface facing upward on the first tray 502. The copy is brought to a halt in a predetermined position where the leading end portion of the copy aligns with that of the tray 502.

Figure 5:
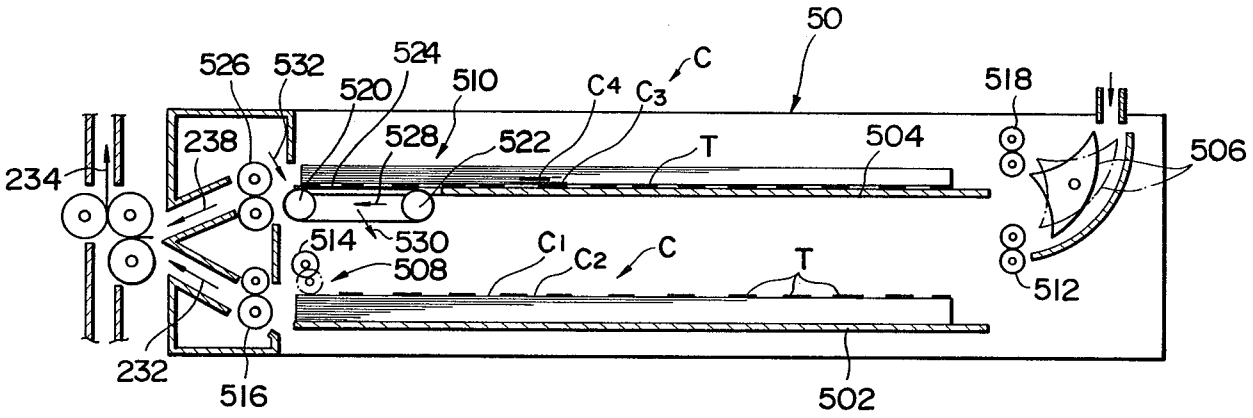
FIG.5 is an enlarged section of the intermediate sheet feeder of FIG. 4.

The above procedure is repeated a preset number of times so that a plurality of one-faced copies C are stacked on the first tray 502 with their images T faced upward, as shown in FIG. 5. As soon as the preset number is reached, the copies are re-fed by the first feed means 508 from the tray 502.

As shown, the first feed means 508 comprises a feed roller 514 and a separator roller pair 516. To re-feed the copies from the tray 502, the feed roller 514 is lowered or the tray 502 is raised until the top copy C1 and the roller 514 come into contact with each other as indicated by a phantom line in FIG. 5 and, then, the roller 514 is rotated. This feeds the top copy C1 to the left in FIG. 5 while being prevented from entraining another sheet. As indicated by arrows 232 and 234, the sheet C1 is routed to the image forming station, i.e. transfer station of the drum 204 in this particular embodiment. Provided with images on the other or second surface at the image forming station, the copy C1 is transported through the fixing unit 220 again and then, usually, discharged from the body 20 as indicated by an arrow 236 without being reversed by the device 224.

While the one-faced copies C on the first tray 502 are re-fed one at a time, their image carrying surfaces are directed upward and, yet, the roller 514 feeds the copies C beginning with the top one. Therefore, as previously discussed in relation to FIG. 3, no noticeable contamination by toner is observed on the copy surfaces.

The double-faced copies coming out of the body 20 are sequentially admitted into the final processing device 40. While a guide 402 is in a phantom line position as shown in FIG. 4, the copies are directly routed to a discharged tray to become finished copies. While the guide 402 is in a solid line position, the copies are stacked on the stapler tray 406; as the copies reach a predetermined number, stapler 408 automatically binds them. Finally, the bound volumes of the copies are discharged to a doggy tail 410 which is swingable in a direction perpendicular to the paper surface of FIG. 4 so as to divide the bundles one by one.

In a composite copy mode in which the one-faced copy fed out from the first sheet feeder 216 or the second 218 is to be provided with document images on the same surface from above the previously reproduced images, the copy carrying the first images and coming out of the fixing unit 220 is not routed into the reversal guide 226 of the device 224 and, instead, fed in a direction indicated by an arrow 230 into the intermediate sheet feeder 50. On the sheet feeder 50, therefore, the copy is positioned face down. As such when a copy is re-fed to the image forming station of the drum 204, other images are reproduced on the same surface of the copy overlying the previous ones. This is the reason why the one-faced copies are stacked on the sheet feeder 50 face down. Should the copies be fed into the first tray 502 and then re-fed by the first feed means 508 the top one first, the copy surfaces would be smeared by toner as shown in FIG. 2 for the reason which has been described with reference to FIG. 1.

In light of the above, in a composite copy mode, the guide member 506 is switched from the solid line position to a phantom line position as shown in FIG. 5. In this condition, the one-faced copies are sequentially delivered toward the second intermediate tray 504 and stacked thereon until they reach a predetermined number. These copies C are re-fed by the second feed means 510 which is made up of a belt 524 passed over two rollers 520 and 522 and a feed roller pair 526. The belt 524 is accommodated in a notch which is formed in the tray 504, and abuts against the bottom copy C3 at the upper surface thereof.

In the event of re-feed, the belt 524 is driven such that its upper run moves as indicated by an arrow 528, while a suction device (not shown) sucks the bottom copy C3 as indicated by an arrow 530. Advantageously, air may be blown against the leading end of the copy as indicated by an arrow 532 in order to prevent the copy from being accompanied by others. In this manner, only the bottom copy C3 is fed to the left as viewed in FIG. 5, then driven by the feed roller pair 526 as indicated by arrows 238 and 234, and then provided with images on the same surface thereof as the previously formed images. Thereafter, the copy C3 with the composite image is fixed by the fixing unit 220 and then driven out of the body 20 as indicated by an arrow 236. It will be apparent that the copy may be routed to the first tray 502 or the second tray 504 after reversing it or without reversing it so as to reproduce images on the other surface or to produce another composite images.

Naturally, where the copies produced by the copier of FIG. 4 are to be discharged as ordinary one-faced copies, they are discharged directly, that is, not by way of the intermediate sheet feeder 50, after being or not being reversed by the device 224.

As described above, the copies are stacked on the second intermediate tray 504 with their images T faced downward. Nevertheless, since they are re-fed from the bottom of the stack, i.e., bottom copy C3, the copy C4 just above the copy C3 is free from noticeable contamination by toner for the reasons as stated in relation to FIG. 3. In short, since the copies are stacked on the first or the second tray either face up or face down depending upon the selected mode, i.e., a double-face copy mode or a composite copy mode, and since the copies are re-fed from the tray from the top one or the bottom one depending upon the orientation of the stacked copies, contamination by toner is eliminated with no regard to the copy mode.

Figure 6:
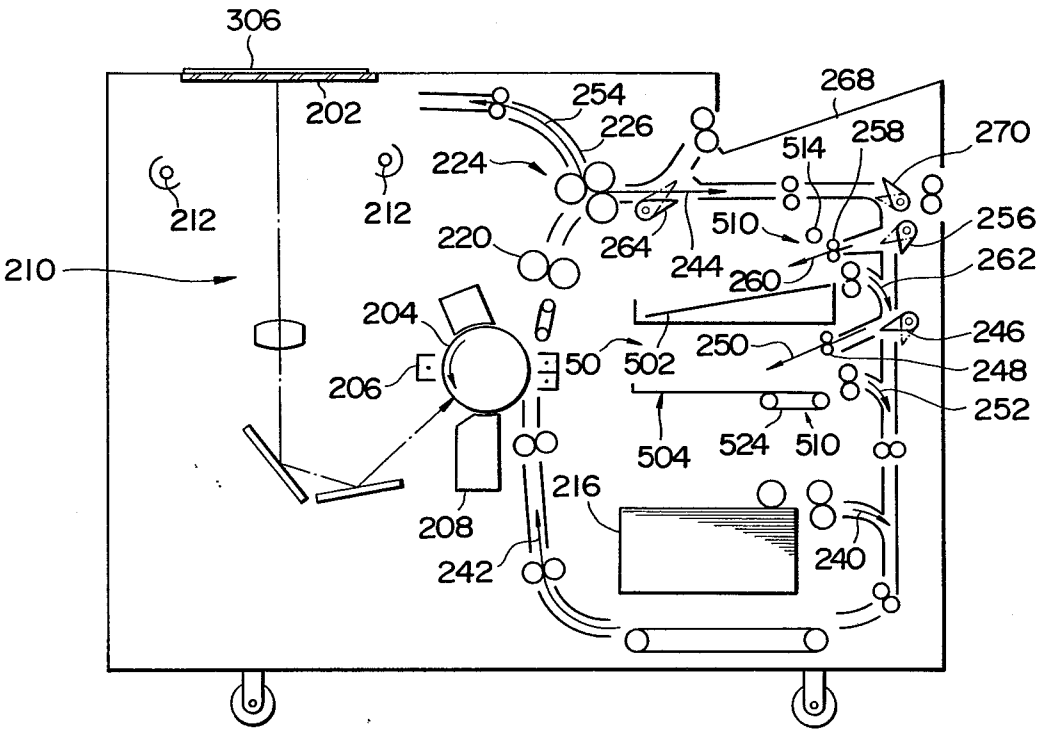
FIG. 6 is a section of a copier in accordance with another embodiment of the present invention.

In FIG. 4 the copier is constructed and arranged such that the copies stacked on the intermediate sheet feeder are positioned face up in a double-face copy mode and face down in a composite copy mode. However, the position of the copies depends upon the construction of the copier, that is, the copies have to be adequately fed to the intermediate trays in conformity to a particular copier construction. For example, in another embodiment of the present invention shown in FIG. 6, the positions of copies which are stacked on the intermediate sheet feeder 50 are opposite to those of FIG. 4. In FIG. 6, the same or similar structural elements as those of FIG. 4 are designated by like reference numerals.

Referring to FIG. 6, reflection from a document 306 on the glass platen 202 is focused by the imaging device 210 onto the drum 204 which has been charged by the charger 206. The resulting latent images provided on the drum 204 are developed by the developing unit 208 to become toner images. The toner images are transferred to a sheet, which is fed from the sheet feeder 216 as indicated by arrows 240 and 242, and then fixed by the fixing unit 220. In a double-face copy mode, the sheet or one-faced copy is advanced as indicated by an arrow 244 without being reversed by the device 224 and then fed by the guide member 246 and roller 248 into the second intermediate tray 504 (arrow 250).

By the above procedure, a predetermined number of copies are stacked on the tray 504 face down. The copies are re-fed by the belt 524 of the second feed means 510 as has been the case with FIG. 5, the bottom copy being fed first as indicated by arrows 252 and 242 toward the drum 204. Then, images will be formed on the other surface of each of the copies.

Meanwhile, in a composite copy mode, the copies coming out of the fixing unit 220 are routed into the reversal guide 226 of the device 224 to be reversed thereby (arrows 254→244). In this mode, the guide member 256 which is in the phantom line position cooperates with the roller 258 to deliver the copies into the first intermediate tray 502 (arrow 260). On the tray 502, the copies are positioned face up.

Re-feed of the copies proceeds in exactly the same way as the re-feed from the first tray of FIG. 5. Specifically, the feed roller 514 of the first feed means 510 is lowered and rotated to feed the top copy toward the drum 204 as indicated by arrows 262 and 242, so that images are reproduced on the same surface as the previously formed images. Needless to mention, at this instant the guide member 246 is in the phantom line position.

In FIG. 6, designated by the reference numeral 264 is a guide member for selectively discharging copies to a discharge section 268, and 270 a guide member for selectively routing the copies toward the final processing device (see FIG. 4).

As described above, the copier of FIG. 6 is constructed such that in a double-face copy mode the copies are fed into the second intermediate tray 504 face down and re-fed from the bottom copy while, in a composite copy mode the copies are loaded on the first intermediate tray 502 face up and re-fed from the top copy. Hence, contamination by toner is eliminated with no regard to the copy mode.

It will be apparent that the means for feeding copies out of the intermediate trays shown and described is not limitative. For example, it may be implemented by the configuration shown in FIG. 1.

Referring to FIGS. 7 to 11B, a copying method which uses a modification to the intermediate sheet feeder 50 and a double-face/composite type copier in which it is installed will be described in detail.

Figure 7:
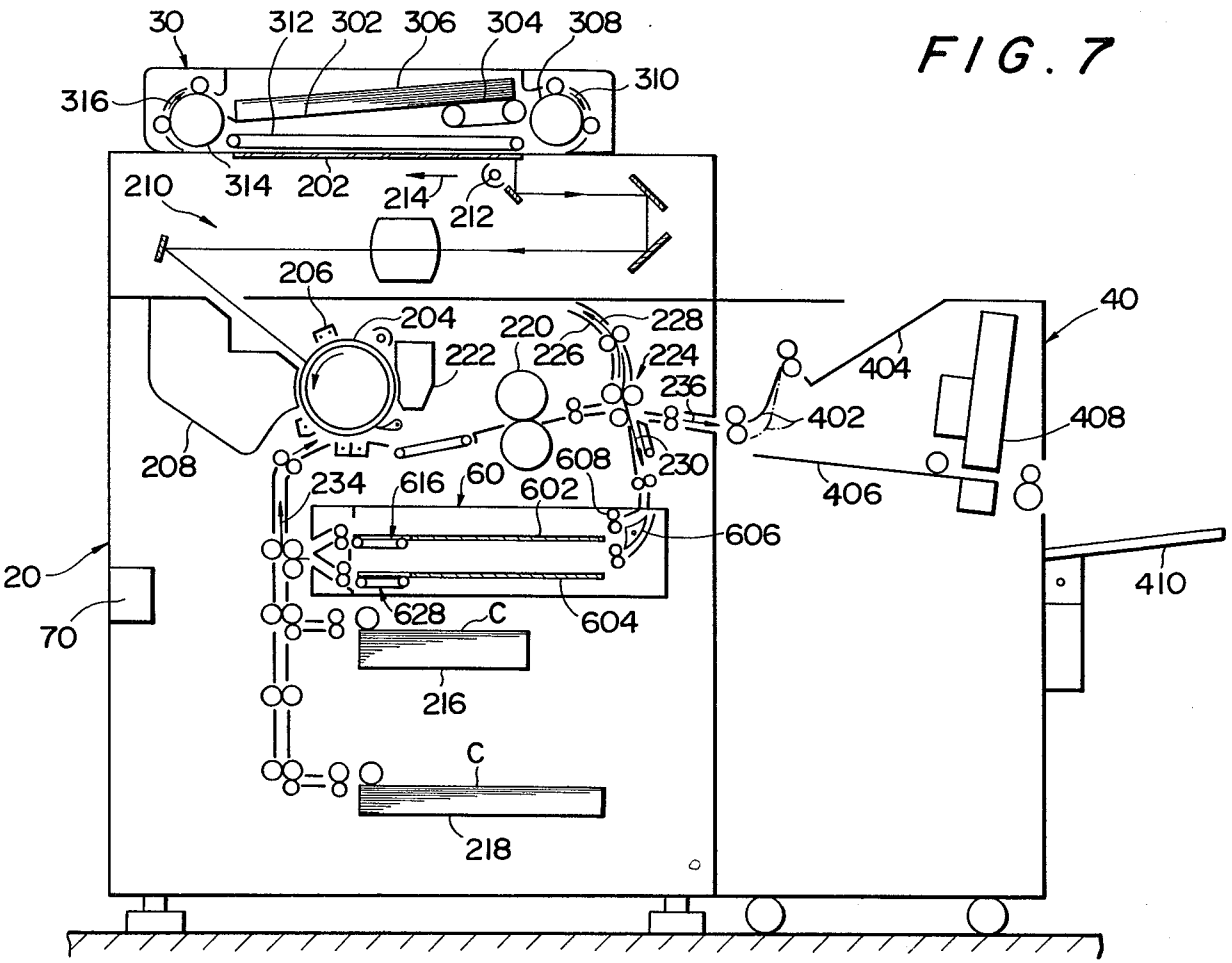
FIG. 7 is a schematic section of a copier equipped with an intermediate sheet feeder in accordance with another embodiment of the present invention.
Figure 8:
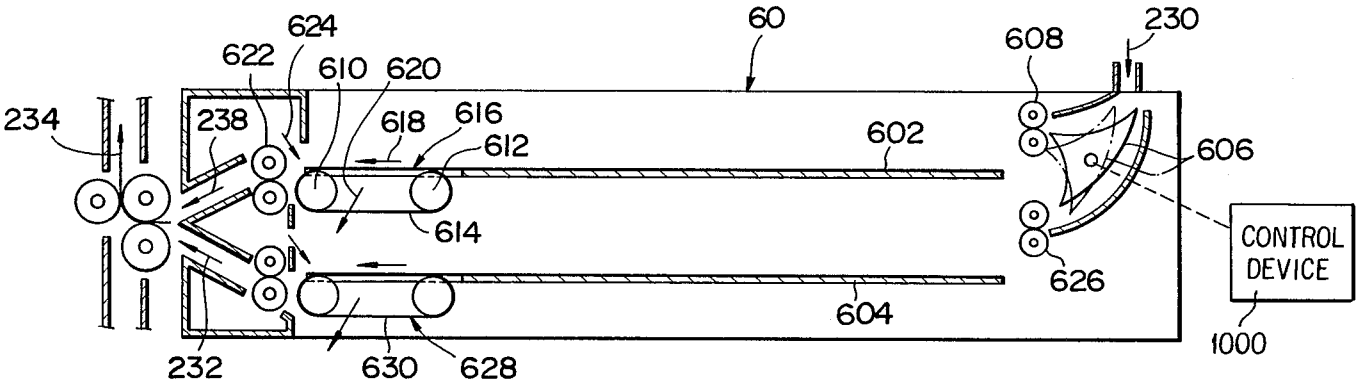
FIG. 8 is a section showing details of the intermediate feeder of FIG. 7.

As shown in FIG. 7, the alternative copier has substantially the same construction as the copier of FIG. 4 except for the modified intermediate sheet feeder. Hence, the same or similar structural elements are designated by line reference numerals. Further, the copier in this particular embodiment is constructed by omitting the first intermediate tray 502 from the intermediate sheet feeder of FIG. 5 and, instead, installing the second intermediate tray 504. Specifically, the modified intermediate sheet feeder, generally 60, comprises vertically overlying two intermediate trays 602 and 604, and selector means implemented by a movable guide member 606 for selectively guiding copies toward the trays 602 and 604. In an ordinary double-face copy mode, the guide member 606 feeds copies into a predetermined one of the intermediate trays. In this particular embodiment, in such a mode the member 606 assumes a solid line position as shown in FIGS. 7 and 8 to feed copies into the intermediate tray 602 and, then, positively loaded on the tray 602 by rollers 608. In this instance, the copies are stacked on the tray 602 face up. Usually, the tray 602 is designed to accommodate a stack of about fifty to hundred copies. In the tray 602, each copy is stopped at a predetermined position where its leading end portion aligns with that of the tray 602. In this position, the leading end portion of the copy lies on a belt 614 of feed means 616 which is passed over two rollers 610 and 612 as shown in FIG. 8. Since the belt 614 is received in a slot which is formed in the leading end portion of the tray 602, the copy can make contact with the belt 614 positively.

To re-feed the copy, the belt 614 is driven as indicated by an arrow 618, while a suction device (not shown) of the feed means 616 sucks the copy downwardly as indicated by an arrow 620. The copy thus fed out of the tray 602 is driven by a feed roller 622 toward the drum 204 as indicated by arrows 238 and 234. To insure the re-feed, it is preferable that the upper surface of the belt 614 be positioned at a slightly lower level than that of the intermediate tray 602, for example. Advantageously, air may be blown against the leading end of the copier as indicated by an arrow 624 in FIG. 8 so as to more surely prevent the copier from entraining others.

In this manner, the copies are re-fed one by one from the intermediate sheet feeder 60 toward the drum 204 to reproduce images on the other surfaces thereof. The double-faced copies are sequentially moved through the fixing unit 220 and then discharged from the body 20 without being reversed by the device 224.

A reference will also be made to FIGS. 9A to 11B for describing more concrete contents of the copying method to which the present invention pertains.

Figure 9A:
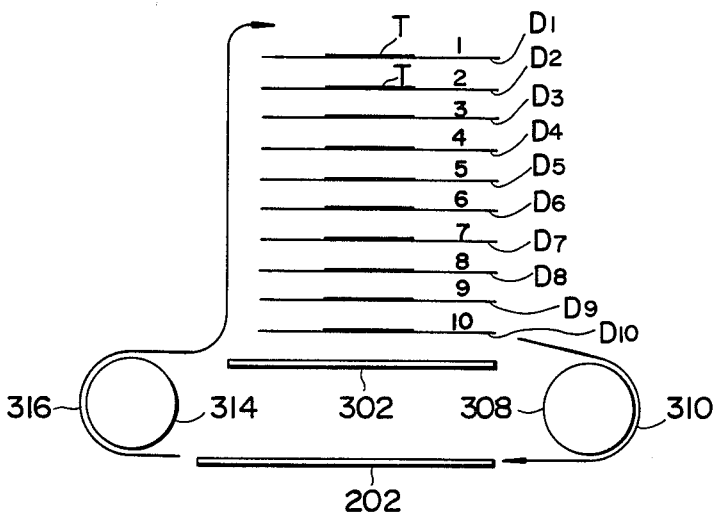
FIGS. 9A–9C are views demonstrating movements of documents, a stacking condition of copies in the intermediate sheet feeder, and a final stacking condition in a bundle of copies.
Figure 9B:
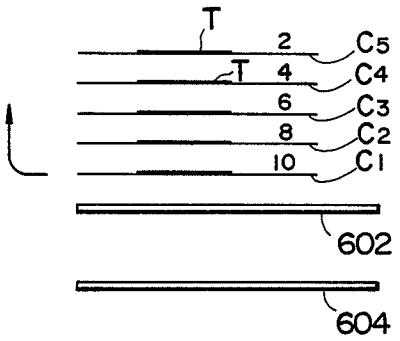

As shown in FIG. 9A, assume that documents D1 to D10 which are paged 1 to 10 as represented by numerals 1 to 10 are stacked on the feed tray 302 of the RADF 30. While the documents D1 to D10 are sequentially fed toward the glass platen 202 as previously stated (arrow 310), every second document is copied. Specifically, when the document D10 paged 10 and positioned at the bottom of the stack is fed to the glass platen 202, its images are reproduced on the first surface of the first sheet which is fed from the first sheet feeder 216 or the second 218. The resulting one-faced copy is stacked on the tray 602 with the image carrying surface faced upward as previously described. In this condition, the copies are stacked as shown in FIG. 9B (C1 designating the first copy). The copy C1 is not re-fed immediately but held in the stack until a predetermined operation ends.

The document D10 is returned to the feed tray 302 and, then, the next document D9 which is paged 9 is fed to the glass platen 202. However, the document D9 is driven past the glass platen 202 without being copied and onto the document D10. When the next document D8 paged 8 is fed to the glass platen 202, it is copied on the first surface of the second sheet C2 (FIG. 9B) which is fed from the sheet feeder 216 or 218. This second one-faced copy C2 is tacked on the tray 602 from above the first copy C1. The document D7 paged 7, like the document D9, is fed and returned by way of the glass platen 202 without being copied. The document D6 which follows the document D7 is copied on the first surface of the third sheet C3 (FIG. 9B), the resulting copy C3 being also stacked on the tray 602.

The above procedure is applied to all the documents with the result that, as shown in FIG. 9B, five copies C1, C2, C3, C4 and C5 associated with every second document are sequentially stacked. In the meantime, the documents are stacked again on the tray 302 in the same order as the initial one.

Thereafter, the documents D10 to D1 are sequentially fed again from the lowermost one D10. This time, those documents which were not copied last time, i.e., odd pages are copied. The document D9 is copied on the second surface of the first copy C1 which is re-fed from the sheet feeder 60 to the drum 204, the document D7 on the second surface of the second copy C2, and so on. On the stapler tray 406, the copies have already been sorted according to the pages of the documents, completing one bundle of copies. The bundle may be immediately bound by means of the stapler 408 to provide a sorted volume of copies. The above procedure may be repeated a desired number of times to produce a desired number of volumes without the need for extra sorting operation. The same holds true with a case wherein the copies are discharged to the tray 404.

Figure 9C:
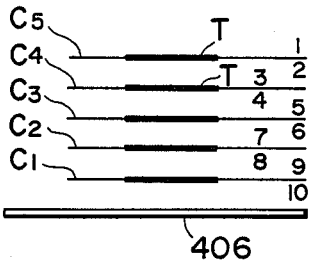

As previously discussed in relation to FIG. 8, the copies stacked on the intermediate sheet feeder 60 are re-fed mainly by the action of the belt 614 from the copy which is in contact with the belt and, hence, the copies stacked on the tray 602 as shown in FIG. 9B are sequentially re-fed from the bottom one C1. Therefore, the bundle of copies finally obtained have been sorted as shown in FIG. 9C.

Figure 10:
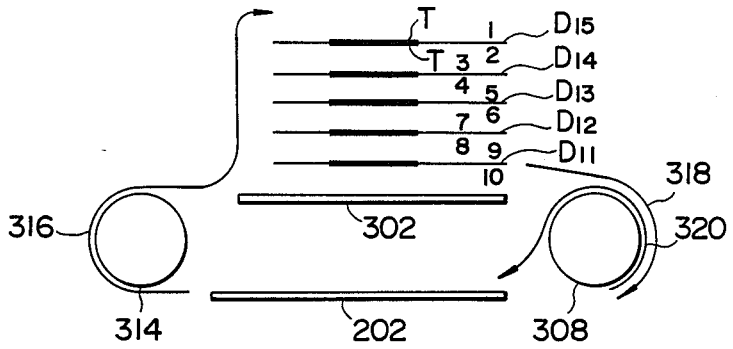
FIG. 10 is a view representative of a method of processing double-faced documents.

Next, assume that double-faced documents are loaded on the tray 302 of the RADF 30, as shown in FIG. 10. In FIG. 10, five double-faced documents D11 to D15 which are paged 1 to 10 are shown. In this condition, first the lowest document D11 is fed by the roller 308 which is rotated counterclockwise as viewed in FIG. 10, as indicated by an arrow 318. Then, the direction of rotation of the roller 308 is reversed to return the document D11 as indicated by an arrow 320 toward the glass platen 202. This causes the final page of the documents, page 10, to face the glass platen 202. After the copying cycle, the document D11 is returned to the tray 302 as indicated by an arrow 316 with the result that it is stacked with its page 10 faced upward. Then, the next document D12 is brought to the glass platen 202 by the same procedure and, after a copying cycle, returned to the tray 302. In this manner, images on one side of each document are copied to provide copies of every second page.

Thereafter, all the documents are sequentially fed again toward the glass platen 202 while being reversed as indicated by arrows 318 and 320, so that the odd pages which were not copied last time are copied. Insofar as the same result is attainable, any other suitable document transport methods which per se are known in the art may be employed such as a one which reverses a document after scanning it. The rest of the copying operation is the same as with one-face documents.

As stated above, whether documents may be one-faced or double-faced, a sorted bundle of copies is achievable by copying images of documents every second page. Moreover, where a one-faced copy which is re-fed from the intermediate sheet feeder 60 for the reproduction of images on the other surface encounters a feed trouble such as jamming in the transport path, the present invention is capable of coping with such a trouble in a simple manner as will be described.

Assume that a copy which has been re-fed from the intermediate tray 602 but not discharged from the body 20 yet has jammed. Then, a jam signal is generated to interrupt the copying operation and displays on a jam position display 70 (FIG. 7) a jammed location and a position of the copy to be removed. The operator removed the jammed copy as guided by the display 70 and, then, depress a reset switch (not shown) or closes the door of the body 20. This produces a reset signal to make the copier ready to resume the operation. Here, it is necessary for supplement a substitute for the removed copy. The supplement is implemented by consecutive steps of: operating the RADF 30 to recirculate the documents to place the particular document which is the match of the images provided on the first surface of the removed copy on the glass platen 202, and reproducing the images on the document on the first surface of a fresh sheet which is fed from the first sheet feeder 216 or the second 218 (FIG. 7).

Figure 11A:
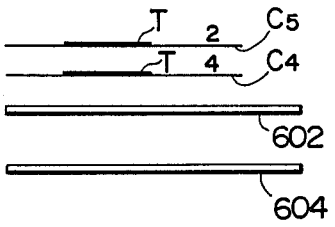
FIGS. 11A and 11B are views showing exemplary conditions of supplementary copies.

To facilitate understanding of the operation associated with the supplement, assume that the third copy sheet C3 shown in FIG. 9B has jammed after the re-feed from the tray 602 by way of example. The jammed sheet C3 is removed by the operator as stated above and, thereafter, the document D6 which is the match of the images provided on the discarded copy C3 is fed from the tray 302 to the glass platen 202 to reproduce the images recorded in page 6 on the first surface of a fresh sheet. This sheet, like the others, is reversed by the device 224 and then fed into the intermediate sheet feeder 60 with the first surface faced upward. In this condition, the copies C4 and C5 each carrying images on its first surface are left on the tray 602, as shown in FIG. 11A. Therefore, should the one-faced new copy (abbreviated as NC hereinafter) be stacked on the tray 602 from above the remaining copies C4 and C5, the feed means 606 would fail to re-feed the substitute NC prior to the others because it is constructed to re-feed copies from the bottom of the stack, thereby disturbing the order of pages of the completed bundle of copies.

Figure 11B:
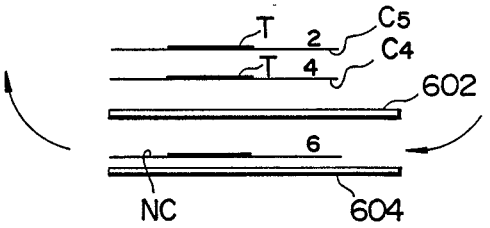

In this particular embodiment, as previously outlined and shown in FIG. 8, the tray 604 is installed in addition to the tray 602 to overcome the above situation. While a roller 626 and feed means 628 are associated with the tray 604, their construction and arrangement are essentially the same as those associated with the tray 602 and, therefore, detailed description thereof will be omitted. When the new copy NC is routed into the intermediate sheet feeder 60, the guide member 606 has been shifted about a fulcrum to the phantom line position as shown in FIG. 8 by a control device 1000. Therefore, the copy NC is driven by the roller 626 into the tray 604 while being guided by the guide member 606 and the underlying guide plate (FIG. 11B).

Thereafter, a particular document associated with images which were formed or expected to be formed on the second surface of the discarded copy C3, i.e., the document D5 in the examples shown in FIG. 9A to 9C and FIG. 10 is accessed and set on the glass platen 202 to be reproduced on the second surface of the substitute NC. For this purpose, the substitute NC is re-fed from the intermediate sheet feeder 22 prior to the others C4 and C5. Specifically, since the leading end of the substitute NC stacked on the tray 604 makes contact with the upper surface of the belt 630, it can be fed out as indicated by arrows 232 and 234 by exactly the same procedure as the ordinary one so as to reproduce the page 5 on the second surface.

After the substitute NC has been re-fed prior to the others C4 and C5 and then provided with a duplicate of the page 5 on its second surface, it is discharged from the body 20 to be stacked on the previously discharged copies C1 and C2. After the substitute NC, the copies C4 and C5 are sequentially fed out by the feed means 616 in the aforesaid manner so that the pages 1 and 3 of the documents which are sequentially brought to the glass platen 202 are copied on the second surfaces of the copies C4 and C5. These copies C4 and C5 are sequentially driven out of the body 20 and stacked on the substitute NC (see FIG. 9C). Hence, the pages of the bundle of copies outside the body 20 are orderly. In this manner, a substitute for a discharged copy can be supplied without any trouble and, yet, automatically.

It sometimes occurs that a plurality of copies which are fed from the intermediate sheet feeder 60 jam at the same time, or that even if the number of jammed copies is one, copies with contamination or with unacceptable images exist before and after the jammed copy (the construction may be such that those copies before and after the jammed one are automatically discharged from the body). In such a situation, discarding all the unacceptable copies results is omission of a plurality of copies. The present invention is capable of easily remedying this situation, too.

Specifically, first a particular document which is the match of images on the first surface of the first defective document is accessed to copy it on the first fresh sheet, then the copy is stacked on the tray 604, then another document which is associated with the images on the first surface of the second defective copy is accessed to copy it on the first surface of the second fresh sheet, then the copy is stacked from above the first-mentioned copy. This sequence of events are repeated for all the defective copies. Thereafter, the substitute copies stacked on the intermediate tray 604 are sequentially re-fed by the feed means 628 from the first substitute, while the images which were formed or to be formed on the second surfaces of the defective copies are reproduced on the substitutes by sequentially accessing their associated documents. This is followed by the ordinary copying cycles for the remaining copies.

This particular embodiment may be modified in various ways. For example, an arrangement may be made such that in a usual copy mode the copies are stacked on the tray 604 and the supplements on the tray 602. Alternatively, three or more intermediate trays may be installed to suitably distribute copies thereto. Further, the present invention may be practiced with an automatic document feeder other than the RADF.

In summary, it will be seen that the present invention has the following advantages.

(1) Whether copies stacked in an intermediate sheet feeder may be positioned face up or face down, they are free from noticeable contamination otherwise observed on their surfaces.

(2) The intermediate sheet feeder includes an intermediate tray adapted to stack copies in a usual copy mode and an intermediate tray adapted to stack substitute copies, so that substitutes may be re-fed prior to the others. This allows copies to be supplemented with ease and, yet, makes it needless to discard acceptable remaining copies and starting copying operation all over again, thereby cutting down losses of cost and time. Further, the supplement can be implemented even when a plurality of substitutes are required. In this case, the substitutes may also be re-fed from with the bottom one as in the illustrative embodiment, so as to maintain the pages of the substitutes orderly.

Various modifications will become possible for those skilled in the art after receiving the teachings of the present disclosure without departing from the scope thereof.

What is claimed is:

1. A copier capable of both double face copying and composite copying, said copier comprising:

image copying means;

means for feeding sheets to have images copied thereon to said copying means;

means for discharging sheets having images copied thereon from said image copying means;

means for selectively reversing sheets in said sheet discharging means; and an intermediate sheet feeder comprising:

(a) a first tray (b) a second tray (c) means for selectively feeding reversed sheets from said sheet discharging means to said first tray and non-reversed sheets from said sheet discharging means to said second tray, whereby all of said sheets in said first tray are image side up and all of said sheets in said second tray are image side down, (d) means for selectively advancing one of the topmost and bottommost sheets in said first tray to said feeding means, and means for selectively advancing the other of the topmost and bottommost sheets in said second tray to said feeding means.

2. A copier having a double face copying function and a composite copying function, comprising:

a copier body for copying images which are recorded in documents on fed sheets to produce copies;

an automatic document feeder for automatically feeding the documents one by one into the copier body;

an intermediate sheet feeder for temporarily stacking the copies and then re-feeding the copies to said copier body, said intermediate sheet feeder comprising a plurality of trays, selector means for selectively routing the copies into said trays, and feed means associated one with each of said trays for feeding of the copies stacked on the trays; and means for maintaining said selector means in one position for selectively routing copies into one of said trays and for shifting said selector means to another position for selectively routing copies into another of said trays when a jammed copy is to be replaced;

whereby every second document fed one by one into the copier body is copied by the copier body, then the copies carrying duplicates of every second document on first surfaces thereof are sequentially stacked on one of the trays of the intermediate sheet feeder according to the order of reproduction, then images on every document alternate to each said second document are copied on second surfaces of the copies which have been sequentially fed from the intermediate sheet feeder beginning with a lowermost one of the copies, and then the copies which carry the document images on both surfaces are discharged from the copier body.

3. A copier as claimed in claim 2, wherein in a usual copy mode the copies carrying the document images on the first surfaces thereof are stacked on a predetermined one of the trays to be re-fed from said predetermined tray.

4. A copier as claimed in claim 3, wherein when any of the copies re-fed from the intermediate sheet feeder for the reproduction on the second surfaces is damaged while in transport, document images which are a match of the images on the first surface of the damaged copy are reproduced on the first surface of a fresh supplementary sheet to produce a substitute, then a substitute is fed into the tray other than the tray which is used in the usual copy mode, then document images which are a match of the images on the second surface of the damaged copy are reproduced on the second surface of the substitute which is re-fed from the intermediate sheet feeder prior to remaining copies, then after the re-feed of the substitute the remaining copies are sequentially re-fed to reproduce document images on the second surfaces thereof.

* * * * *